US007900540B1

(12) United States Patent
Te

(10) Patent No.: US 7,900,540 B1
(45) Date of Patent: Mar. 8, 2011

(54) FOLDABLE TOOL KIT

(76) Inventor: Wu Shu Te, Taichung Hsien (TW)

( * ) Notice: Subject to any disclaimer, the term of this patent is extended or adjusted under 35 U.S.C. 154(b) by 0 days.

(21) Appl. No.: 12/155,895

(22) Filed: Jun. 11, 2008

Related U.S. Application Data

(62) Division of application No. 11/486,212, filed on Jul. 14, 2006, now abandoned.

(30) Foreign Application Priority Data

Mar. 8, 2006 (TW) ..... 95203866 U

(51) Int. Cl.
*B25B 23/00* (2006.01)

(52) U.S. Cl. ..... 81/440; 7/128; 7/138; 7/168

(58) Field of Classification Search ..... 81/440, 81/177.6, 177.4, 439, 427.5, 489, 490; 206/276–378, 206/372, 243; 7/128, 138, 168, 167, 118
See application file for complete search history.

(56) References Cited

U.S. PATENT DOCUMENTS

| | | | | |
|---|---|---|---|---|
| 5,303,439 | A * | 4/1994 | Seals | 7/138 |
| 5,711,042 | A * | 1/1998 | Chuang | 7/138 |
| 6,112,351 | A * | 9/2000 | Hawkins et al. | 7/138 |
| 6,286,168 | B1 * | 9/2001 | Woodruff et al. | 7/138 |
| 6,574,817 | B2 * | 6/2003 | Wu | 7/138 |
| 6,637,061 | B1 * | 10/2003 | Spracklin et al. | 7/138 |
| 6,751,819 | B2 * | 6/2004 | Chuang | 7/100 |
| 6,751,820 | B1 * | 6/2004 | Wu | 7/118 |
| 6,916,106 | B2 * | 7/2005 | Xingguo | 362/253 |
| 6,988,288 | B2 * | 1/2006 | Wang | 7/138 |
| 7,140,280 | B2 * | 11/2006 | Hawkins et al. | 81/440 |
| D549,542 | S * | 8/2007 | Chiang | D8/105 |
| 7,281,456 | B2 * | 10/2007 | Chiang | 81/440 |
| 7,299,514 | B2 * | 11/2007 | Wu | 7/138 |
| 2002/0194679 | A1 * | 12/2002 | Hawkins | 7/128 |
| 2006/0042428 | A1 * | 3/2006 | Chuang | 81/440 |

* cited by examiner

*Primary Examiner* — D. S Meislin
(74) *Attorney, Agent, or Firm* — Guice Patents PLLC

(57) ABSTRACT

A foldable tool kit including a case having two sideboards and several tools side by side arranged between the two sideboards. Each of the tools has a rod body, a pivoted end formed with a pivot hole and an operation end for driving a threaded member. The tools are pivotally disposed at least one end of the case via a pivot shaft. The foldable tool kit is flattened and lightweight and has beautified appearance. The volume of the foldable tool kit is minimized so that it is easy to carry and store the foldable tool kit.

12 Claims, 7 Drawing Sheets

FOLDABLE TOOL KIT

This application is a Division of application U.S. Ser. No. 11/486,212, entitled "FOLDABLE TOOL KIT" and filed Jul. 14, 2006 now abandoned.

BACKGROUND OF THE INVENTION

The present invention is related to a hand tool, and more particularly to a foldable tool kit, which is flattened and lightweight and has a delicate shape.

FIG. 10 shows a conventional foldable tool kit 1 having a case 2. Two ends of the case 2 are respectively equipped with two pivot shafts 3 on which various tools 4 are pivoted. The tools 4 can be unfolded outward for use or can be folded into the case 2. Each tool 4 is a substantially q-shaped rod having a circular or hexagonal cross-section. That is, each tool has a pivoted end 5 curled into a circular section defining a circular hole through which the pivot shaft is fitted. Accordingly, the tools can be pivoted about the pivot shaft.

The conventional foldable tool kit has a shortcoming. That is, the pivoted end of the tool has a thickness much larger than the diameter of the rod body of the tool. Therefore, as a whole, the tool kit has a considerable thickness and weight.

SUMMARY OF THE INVENTION

It is therefore a primary object of the present invention to provide a flattened and lightweight foldable tool kit which is easy to carry and store.

The present invention can be best understood through the following description and accompanying drawings wherein:

DETAILED DESCRIPTION OF THE PREFERRED EMBODIMENTS

Figure 1:
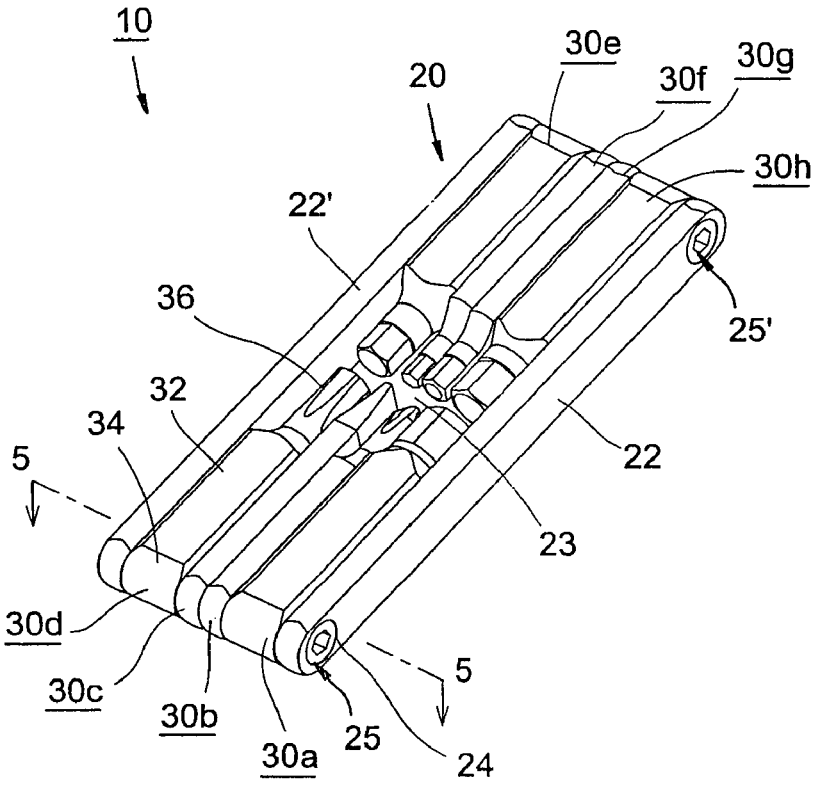
FIG. 1 is a perspective view of a first embodiment of the present invention.
Figure 2:
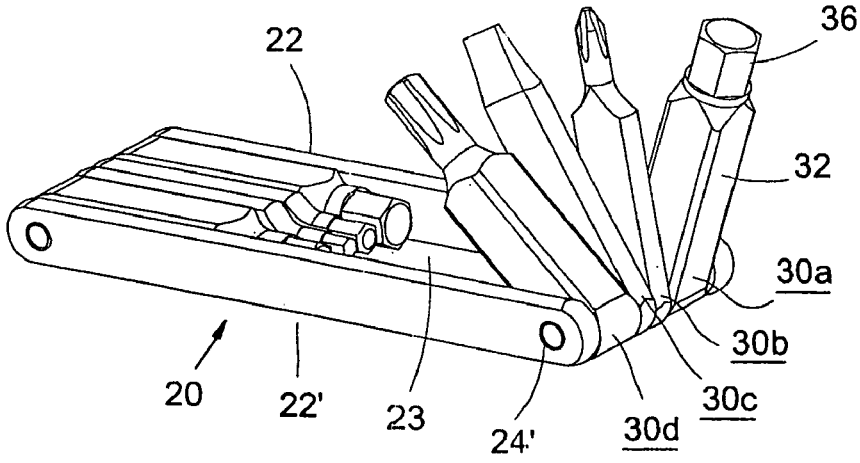
FIG. 2 is a perspective view according to FIG. 1, in which some of the tools are unfolded outward.

Please refer to FIGS. 1 and 2. The foldable tool kit 10 of the present invention includes a case 20 and several tools 30 pivotally connected with one end or two ends of the case 20.

In this embodiment, the case 20 is composed of two parallel sideboards 22, 22'. Two pivot shafts 25 are respectively interconnected between first ends of the two sideboards 22, 22' and second ends of the two sideboards 22, 22'. The tools 30 are respectively pivoted on the two pivot shafts 25 side by side between the two sideboards 22, 22'. The tools 30 can be folded into a space 23 defined by the case 20 as shown in FIG. 1. Alternatively, the tools 30 can be unfolded for use as shown in FIG. 2.

Figure 3:
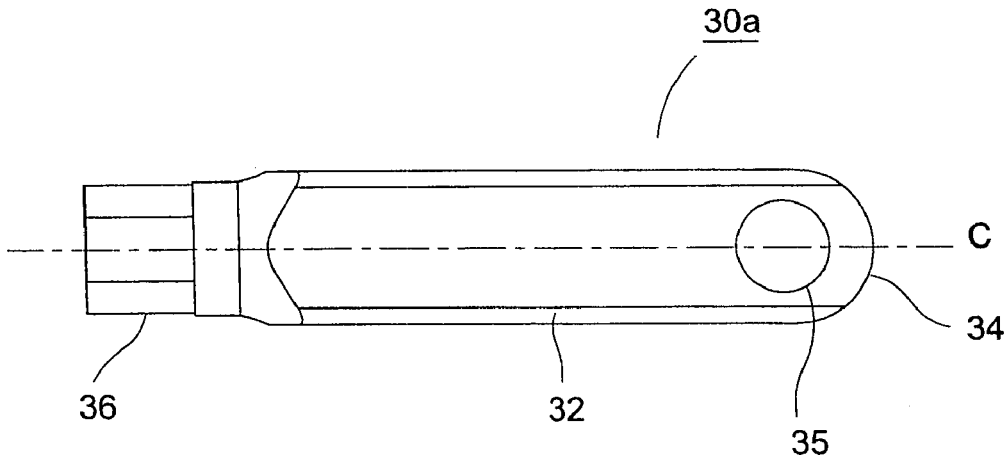
FIG. 3 is a side view of one of the tools.

Referring to FIG. 3, each tool 30 has a rod body 32. One end of the rod body 32 is a pivoted end 34, while the other end of the rod body 32 is an operation end 36 formed with a specific configuration. For example, the operation end can be hexagonal, cross-shaped, wedge-shaped, etc. for driving a threaded member. The pivoted end 34 is formed with a pivot hole 35 through which the pivot shaft 25 is fitted.

The central lines C of the operation end 36, the rod body 32, the pivoted end 34 and the pivot hole 35 of the tool coincide with each other. Also, the pivoted end 34 has a height (thickness) not larger than the height (thickness) of the rod body. Accordingly, the tool 30 of the present invention has a height much smaller than that of the tool of the conventional tool kit. Therefore, the tool kit of the present invention is thinner and lighter.

Figure 4:
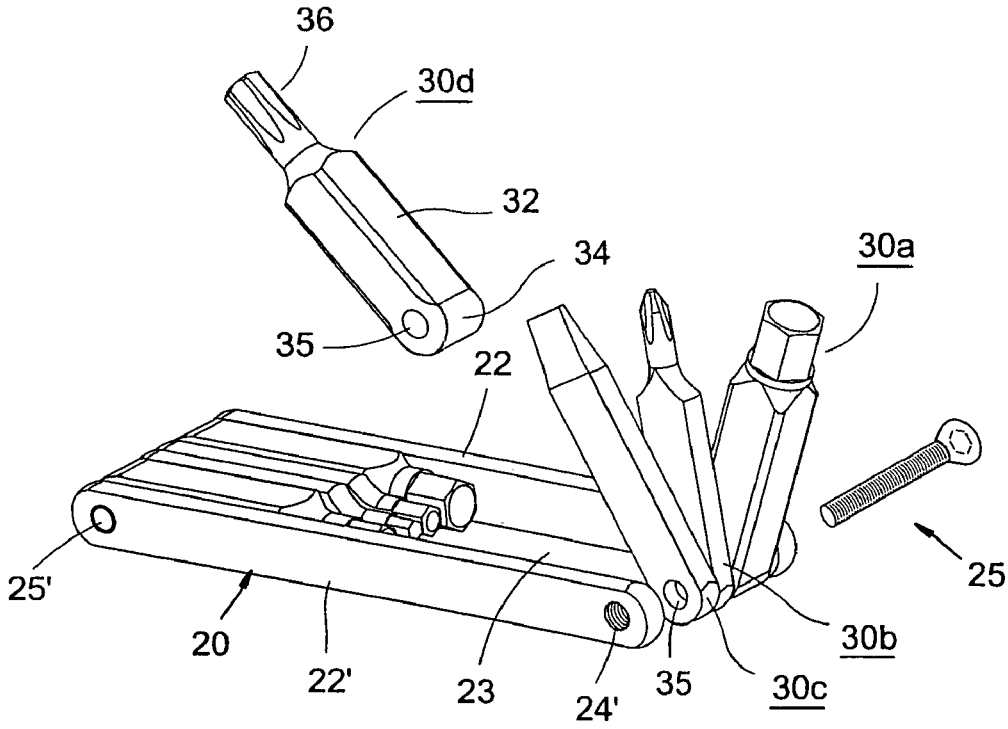
FIG. 4 is a perspective partially exploded view according to FIG. 1.
Figure 5:
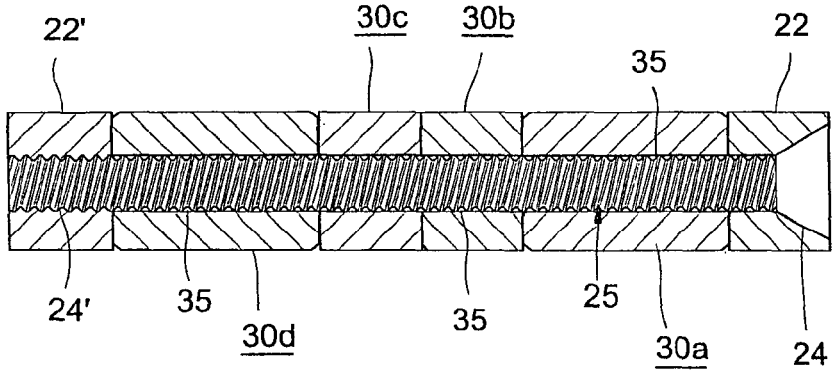
FIG. 5 is a sectional view taken along line 5-5 of FIG. 1.

Referring to FIGS. 4 and 5, with the tools 30*a*, 30*b*, 30*c*, 30*d* pivotally disposed at one end of the case 20 exemplified, the pivot holes 35 of the tools 30*a* to 30*d* are simply through holes. The pivot hole 24 of the first end of the first sideboard 22 is also a through holes, while the pivot hole 24' of the first end of the second sideboard 22' is a thread hole. The pivot shaft 25 is a bolt formed with outer thread. The bolt is fitted through the pivot hole 24 of the first sideboard 22 and the pivot holes 35 of the tools 30*a* to 30*d* and finally screwed into the thread hole 24' of the sideboard 22'. Accordingly, the tools 30*a* to 30*d* are pivotally connected with the sideboards 22, 22' by means of the pivot shaft 25, that is, the bolt 25. The tools can be pivoted about the pivot shaft 25.

Similarly, the tools 30*e*, 30*f*, 30*g*, 30*h* and the sideboards 22, 22' are pivotally connected in the same manner. The pivot holes of the tools 30*e* to 30*h* are simply through holes. The pivot hole of the second end of the sideboard 22 or 22' is also a through holes, while the pivot hole of the second end of the sideboard 22' or 22 is a thread hole. The pivot shaft 25' is a bolt formed with outer thread. The bolt is fitted through the pivot hole 24 of the sideboard 22 or 22' and the pivot holes of the tools 30*e* to 30*h* and finally screwed into the thread hole of the sideboard 22' or 22. Accordingly, the tools can be pivotally connected with the sideboards 22, 22' simply by means of the bolts without using any nut. Therefore, the tool kit can be flattened to minimize the thickness thereof.

In the case that both ends of the case are equipped with the tools as shown in FIG. 1, when the tools are folded into the case 20, the centers of the tools 30*a* to 30*d* located at one end of the case and the centers of the tools 30*e* to 30*h* at the other end are on the same plane.

Besides, a resilient washer (not shown) can be disposed between each two adjacent tools such as 30*a*, 30*b* or between the sideboard 22 and the tool 30*a* or between the sideboard 22' and the tool 30*d*, whereby the tools and the sideboards will not loosen.

Figure 6:
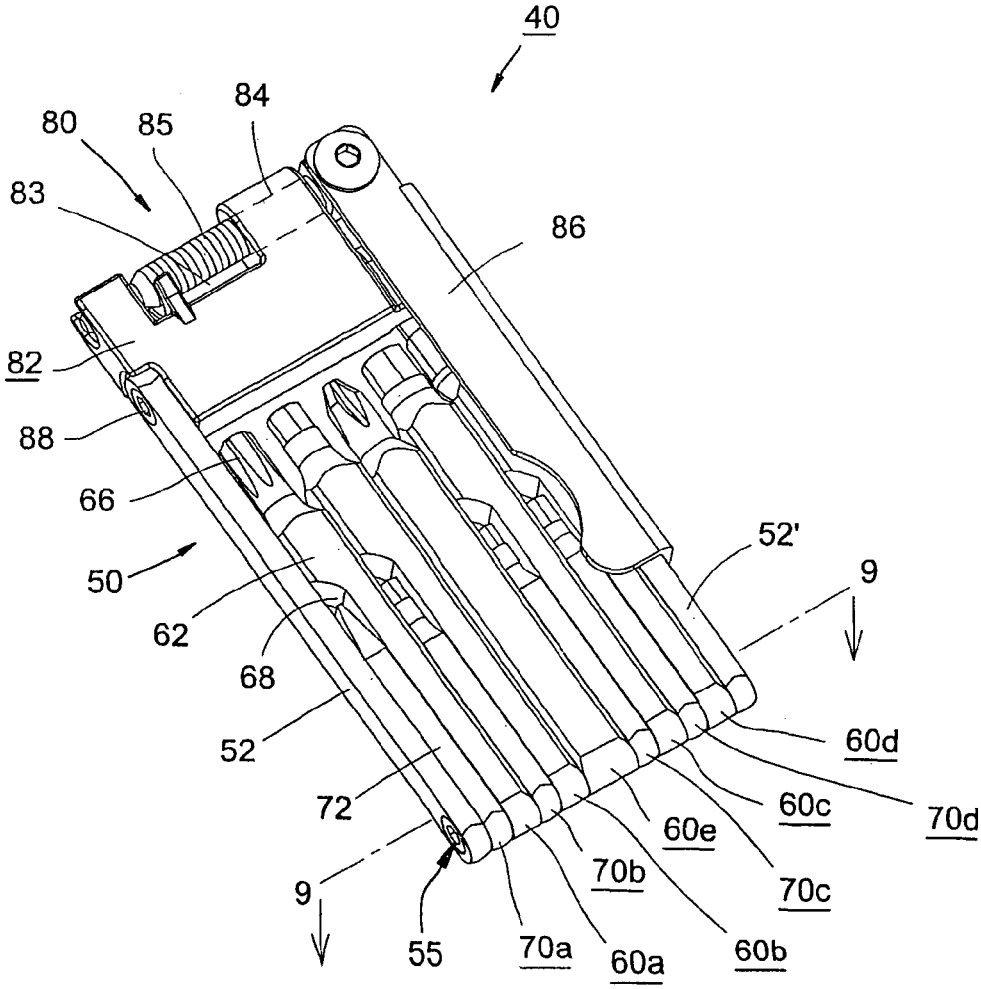
FIG. 6 is a perspective view of a second embodiment of the present invention.
Figure 7:
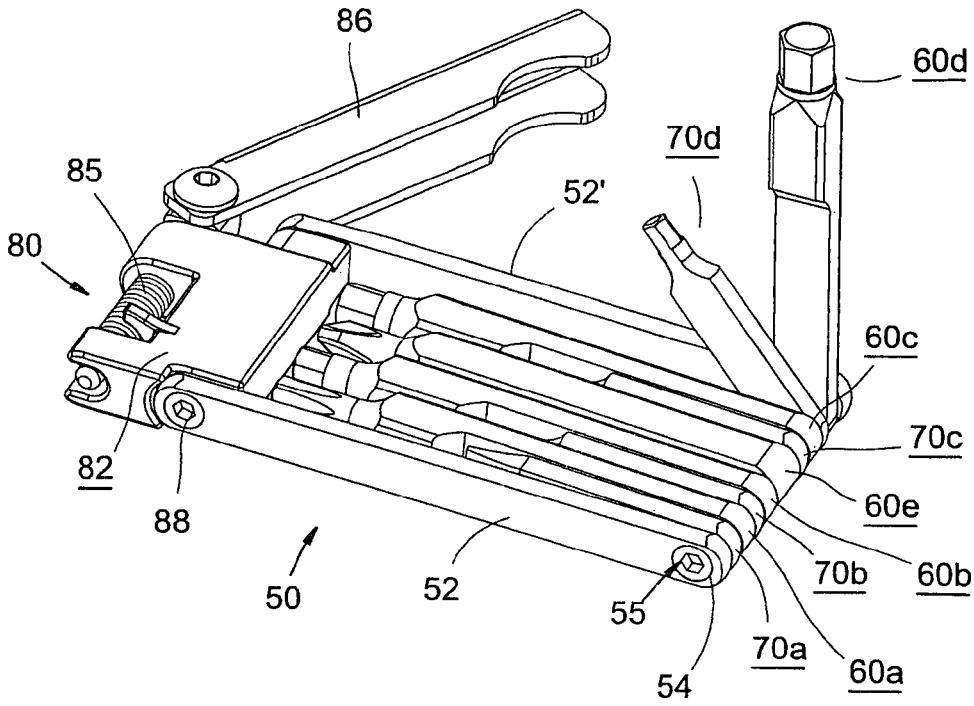
FIG. 7 is a perspective view according to FIG. 6, in which some of the tools are unfolded outward.

FIGS. 6 and 7 show another embodiment of the tool kit 40 of the present invention, which also includes a case 50 composed of two sideboards 52, 52'. Several tools are pivotally disposed at one end of the case 50 via a pivot shaft 55.

Figure 8:
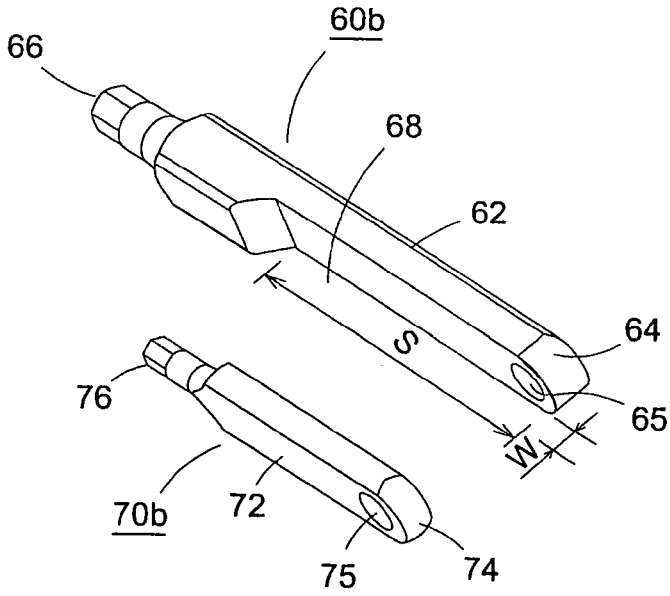
FIG. 8 is a perspective view showing some of the tools.

In this embodiment, the tools are divided into tools 60*a* to 60*e* with normal sizes and smaller tools 70*a* to 70*d*. Please refer to FIG. 8. With the normal tool 60*b* and smaller tool 70*b* exemplified, each normal tool 60 has a rod body 62, a pivoted end 64 and an operation end 66. The pivoted end is formed with a pivot hole 65. Similarly, each smaller tool 70 has a rod body 72, a pivoted end 74 formed with a pivot hole 75 and an operation end 76. The centers of the operation end, the rod body, the pivoted end and the pivot hole of each tool are positioned in the same central line. In addition, the height (thickness) of the pivoted end is not larger than the height (thickness) of the rod body.

One side of the normal tool 60*b* is recessed to form a sink 68 extending from the pivoted end 64 to the rod body 62 by a certain length. The smaller tool 70*b* has a length shorter than the length S of the sink 68. The width of the smaller tool 70*b* is not larger than the width W of the sink 68. Accordingly, referring to FIGS. 6 and 7, the smaller tools 70 can be respectively snugly positioned in the sinks 68 of the normal tools 60 side by side. The smaller tools 70 can be also unfolded outward for use.

Figure 9:
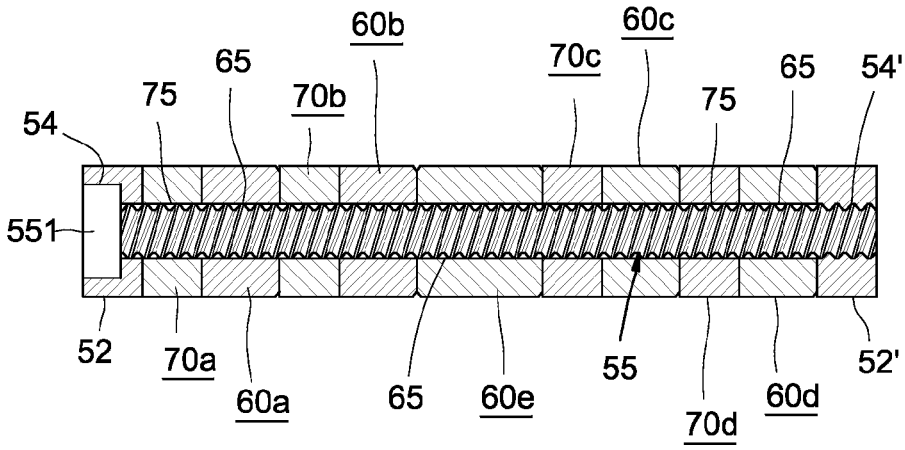
FIG. 9 is a sectional view taken along line 9-9 of FIG. 6.
Figure 10:
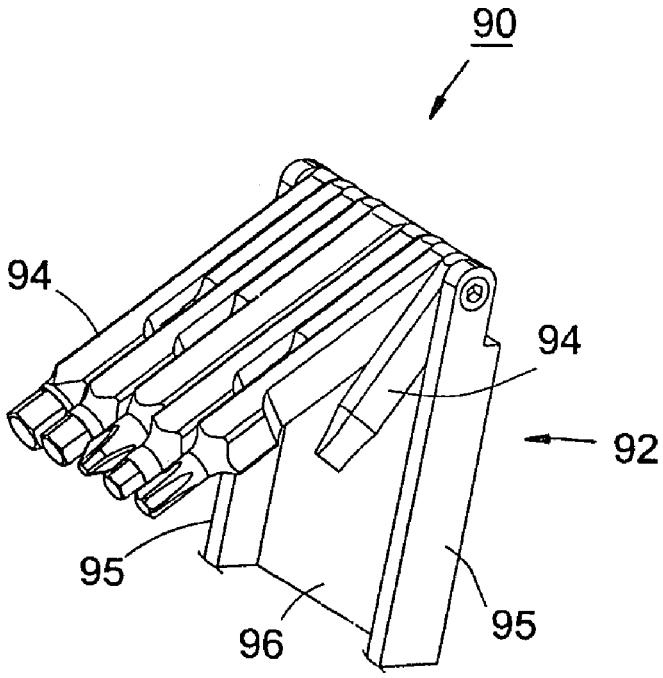
FIG. 10 is a perspective view of a conventional foldable tool kit.
Figure 11:
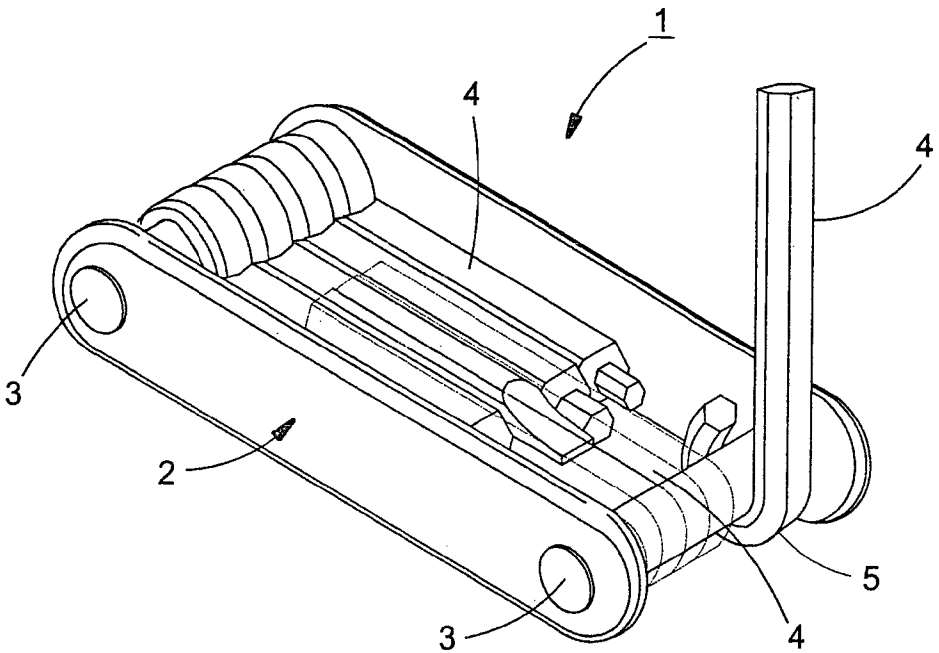
Fig. 11 PRIOR ART

The tools are side by side arranged between the two sideboards 52, 52'. Referring to FIG. 9, the pivot holes 65, 75 of the tools 60, 70 are all through holes. The pivot holes 54 of the sideboard 52 are through hole, while the pivot holes 54' of the sideboard 52' are thread hole. The pivot shafts 55 are fitted through the through holes of the sideboard 52 and the tools and then screwed into the thread holes 54' of the sideboard 52'.

The design of this embodiment is applicable to the first embodiment.

Furthermore, the tool kit 40 of this embodiment further includes a chain cutter 80 including a body section 82 and a pushpin 85. A front end of the body section 82 is formed with a cavity 83 for placing a chain therein. The body section 82 is formed with a thread hole 84 communicating with the cavity 83. The pushpin 85 is screwed in the thread hole 84, whereby the pushpin can extend into the cavity 83. The chain cutter 80 further includes an operation lever 86 having a U-shaped cross-section. One end of the operation lever 86 is pivotally connected with an outer end of the pushpin 85 for driving and rotating the pushpin. The body section 82 of the chain cutter 80 is fixedly connected with the other end of the case 50 via another pivot shaft 88 (not limited to the shown one) or a fixing pin. When not used, the operation lever 86 is folded to snugly hold a sideboard so as to minify the volume. The height of the body section of the chain cutter is substantially the same as a height of each tool and substantially the same as a height of each the sideboard.

In conclusion, the foldable tool kit of the present invention is thin, flattened and lightweight and has beautified appearance. The volume of the foldable tool kit is minimized so that it is easy to carry and store the foldable tool kit.

The above embodiments are only used to illustrate the present invention, not intended to limit the scope thereof. Many modifications of the above embodiments can be made without departing from the spirit of the present invention.

What is claimed is:

1. A foldable tool kit comprising:

two sideboards;

at least two tools side by side arranged between the two sideboards, each of the tools having a rod body, one end of the rod body being an operation end, while the other end of the rod body being a pivoted end formed with a pivot hole; the tools being pivotally disposed at first ends of the sideboards via a pivot shaft, whereby the tools can be pivoted about the pivot shaft;

the center of the rod body and the center of the pivot hole of each tool being positioned in the same central line, the height of the pivoted end being not larger than the height of the rod body; and a chain cutter including a body section and a pushpin; a front end of the body section being formed with a cavity for placing a chain therein; one side of the body section being formed with a thread hole communicating with the cavity; the pushpin being screwed in the thread hole, whereby the pushpin can extend into the cavity; the chain cutter further including an operation lever pivotally connected with an outer end of the pushpin for driving and rotating the pushpin; the body section of the chain cutter being disposed at second ends of the sideboards; whereby the tool kit is flattened, wherein the height of the body section of the chain cutter is substantially the same as a height of each tool.

2. The foldable tool kit as claimed in claim 1, wherein the operation lever has a U-shaped cross-section, whereby when not used, the operation lever is folded to snugly hold a sideboard.

3. The foldable tool kit as claimed in claim 1, wherein the body section of the chain cutter is connected with the second ends of the sideboards via a rod member.

4. The foldable tool kit as claimed in claim 2, wherein the body section of the chain cutter is connected with the second ends of the sideboards via a rod member.

5. The foldable tool kit as claimed in claim 1, wherein the tools are divided into tools with normal sizes and smaller tools, one side of the rod body of each of at least some of the normal tools being recessed to form a sink extending from the pivoted end to the rod body; the smaller tool having a length shorter than a length of the sink, and having a width not larger than a width of the sink; whereby the smaller tools can be respectively snugly accommodated in the sinks of the normal tools.

6. The foldable tool kit as claimed in claim 5, wherein the operation lever has a U-shaped cross-section, whereby when not used, the operation lever is folded to snugly hold a sideboard.

7. The foldable tool kit as claimed in claim 5, wherein the body section of the chain cutter is connected with the second ends of the sideboards via a rod member.

8. The foldable tool kit as claimed in claim 1, wherein the height of the sideboard is substantially the same as a height of the tool.

9. The foldable tool kit as claimed in claim 1, wherein each of first ends of the sideboards is formed with a pivot hole, the pivot hole of the first sideboard being a through hole, while the pivot hole of the second sideboard being a thread hole; the pivot shaft being a bolt formed with outer thread at least at a rear end, the pivot shaft being fitted through the pivot holes of the first sideboard and the tools and then screwed into the pivot hole of the second sideboard.

10. The foldable tool kit as claimed in claim 1, wherein a resilient washer is disposed between each two adjacent tools.

11. The foldable tool kit as claimed in claim 1, wherein a resilient washer is disposed between a tool and a sideboard.

12. The foldable tool kit as claimed in claim 1, wherein the centers of the operation end, the rod body and the pivot hole of each tool are positioned in the same central line.

* * * * *